United States Patent [19]

Balkus

[11] Patent Number: 4,637,872

[45] Date of Patent: Jan. 20, 1987

[54] GRAVEL WASHER SEPARATOR

[76] Inventor: Carl E. Balkus, 147 Deep Wood Dr., Amston, Conn. 06231

[21] Appl. No.: 722,816

[22] Filed: Apr. 12, 1985

[51] Int. Cl.[4] ..... B03B 5/58; B04B 1/06

[52] U.S. Cl. ..... 209/453; 209/465; 209/492; 209/500; 494/27; 494/52; 494/68

[58] Field of Search ..... 209/453, 479, 480, 481, 209/500, 501, 199, 465, 492, 495; 494/27, 52, 68, 70, 80

[56] References Cited

U.S. PATENT DOCUMENTS

| | | | |
|---|---|---|---|
| 663,296 | 12/1900 | Newkirk | 209/453 |
| 865,542 | 9/1907 | Stringham | 209/453 |
| 1,003,118 | 9/1911 | McKellar | 209/199 |
| 2,039,291 | 5/1932 | Bright | 209/453 |

*Primary Examiner*—S. Leon Bashore
*Assistant Examiner*—Thomas M. Lithgow
*Attorney, Agent, or Firm*—McCormick, Paulding & Huber

[57] ABSTRACT

A centrifugal separator has a rotating tub with annular dams to trap the heavier components of the slurry fed into the tub through a centrally located feed tube. The latter rotates at a speed slightly different from that of the tub and supports radially extending spokes that have depending tines provided with lower nozzle defining ends in the annular spaces between the dams. Water under pressure emanates from these nozzles. An alternative tub configuration has annular water manifolds inside these annular spaces to provide water under pressure to nozzles in the tub itself for supplementing the action of the nozzles in the depending tines.

18 Claims, 4 Drawing Figures

GRAVEL WASHER SEPARATOR

This invention relates generally to centrifugal ore separation devices, and deals more particularly with a portable such device which is especially suited to meet the varied conditions encountered in separating gravel from gold ore.

The general purpose of the present invention is to provide an improved separator for extracting gold and/or gold concentrates from ore and gravel and other minerals with the aid of a rotating centrifugal tub into which water, gravel and the ore are fed so that the heavier ore is trapped in portions of the tub and the excess water and gravel allowed to exit in a more efficient manner than is possible with prior art centrifugal separators of this general type.

SUMMARY OF THE INVENTION

In carrying out the present invention an improved separator is provided with a fixed frame including a fixed spindle adapted to rotatably support the rotating tub. The tub has a center post portion and bearing means provided between this center post and the fixed spindle. The upwardly open tub has a plurality of spaced annular dams or ribs projecting from the inside walls of the tub so as to define annular spaces therebetween. Also provided on the spindle for rotation on the same axis as that of the tub is an improved rake means which is preferably driven at a speed slightly less than that of the tub. The rake means itself is provided on a rotating tubular feed means for receiving the slurry of gold, gravel and water. The rake means itself is defined by a plurality of generally radially outwardly extending spokes which are secured at their inner ends to the tubular feed means and the tubular feed means also has an internal spider for supporting the entire rotating rake structure on the center spindle, which also supports the tub, for rotation on a vertial axis.

The rake means is more particularly defined by a peripherally extending ring or hoop at the outer ends of the spokes and downwardly projecting tines are provided on the spokes, and preferably on the ring as well, such that the lower ends of these tines are arranged in the annular spaces provided between the dams of the tub.

A water manifold rotates with the rake means and at least some of the tines have nozzles in the lower end portions thereof such that water can be emitted under pressure into the annular spaces so defined by the tub dams. Water is provided to the rotating manifold through a fluid coupling also provided on the central axis of the tub and rake means.

In an alternative version the tub itself has a manifold rotating with it, and water is injected into the area below the tub's dams.

DETAILED DESCRIPTION

Figure 1:
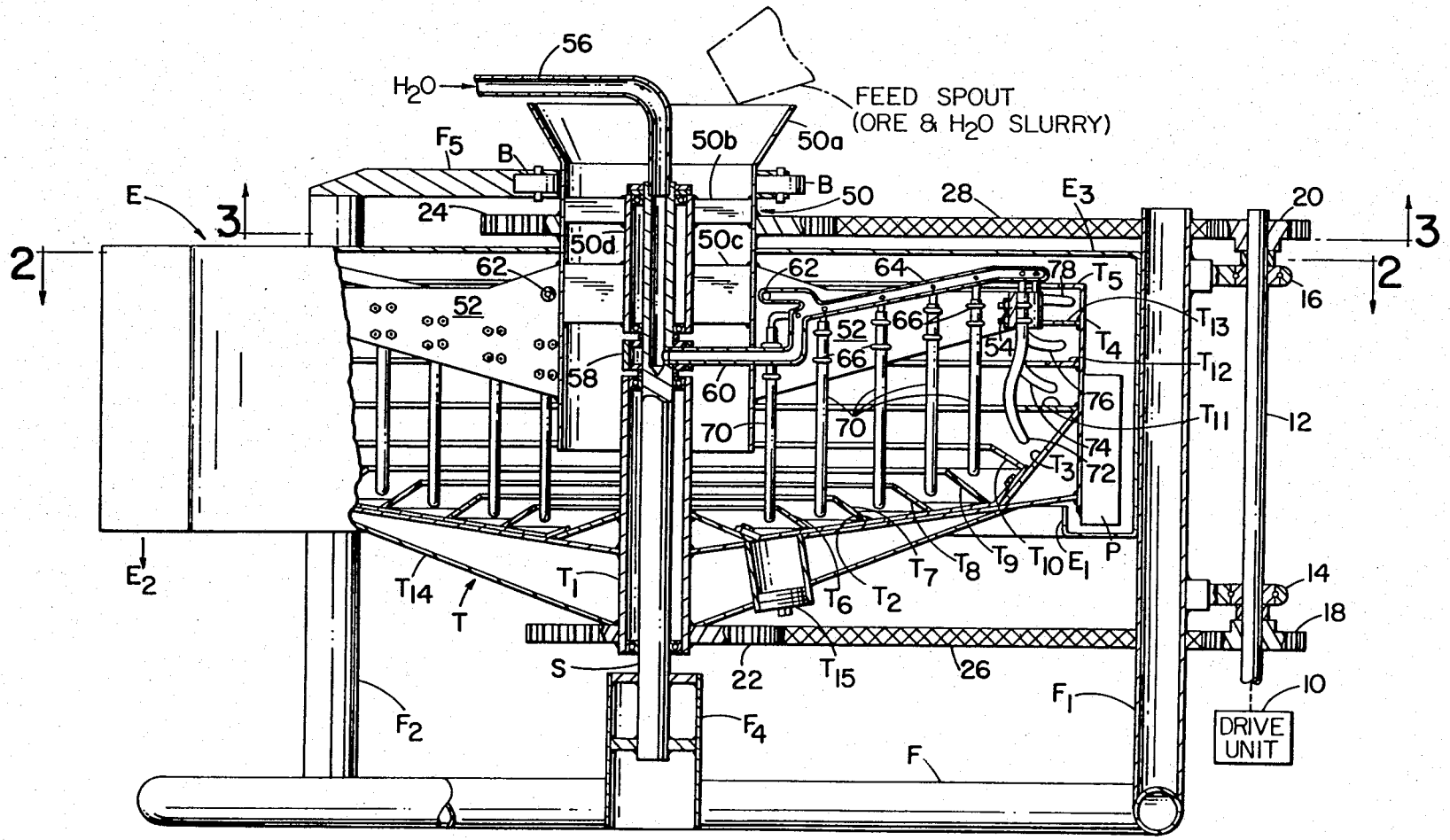
FIG. 1 is a vertical elevational view with portions broken away and is taken generally on the line 1—1 of FIG. 2.
Figure 2:
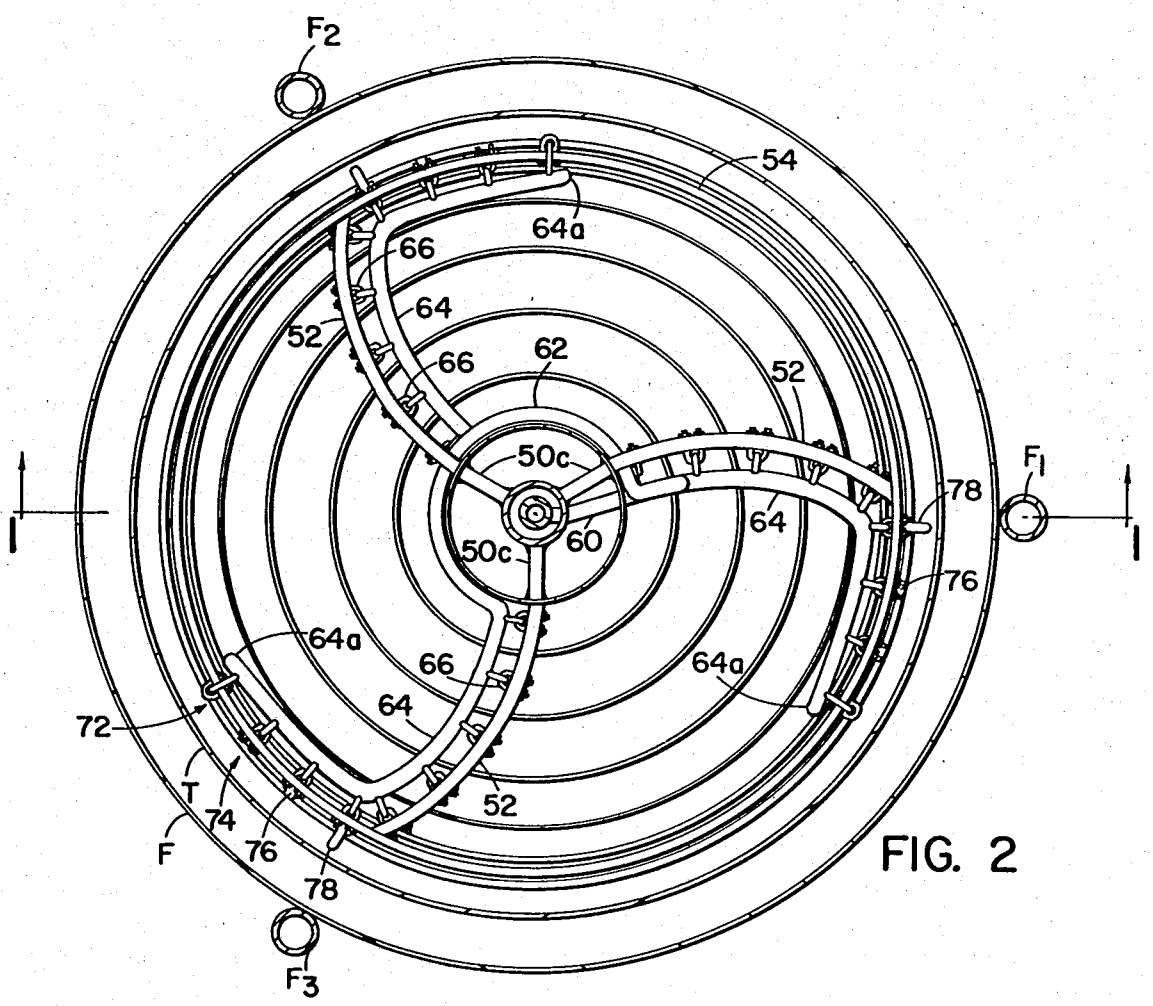
FIG. 2 is a horizontal sectional view taken generally on the line 2—2 of FIG. 1.
Figure 3:
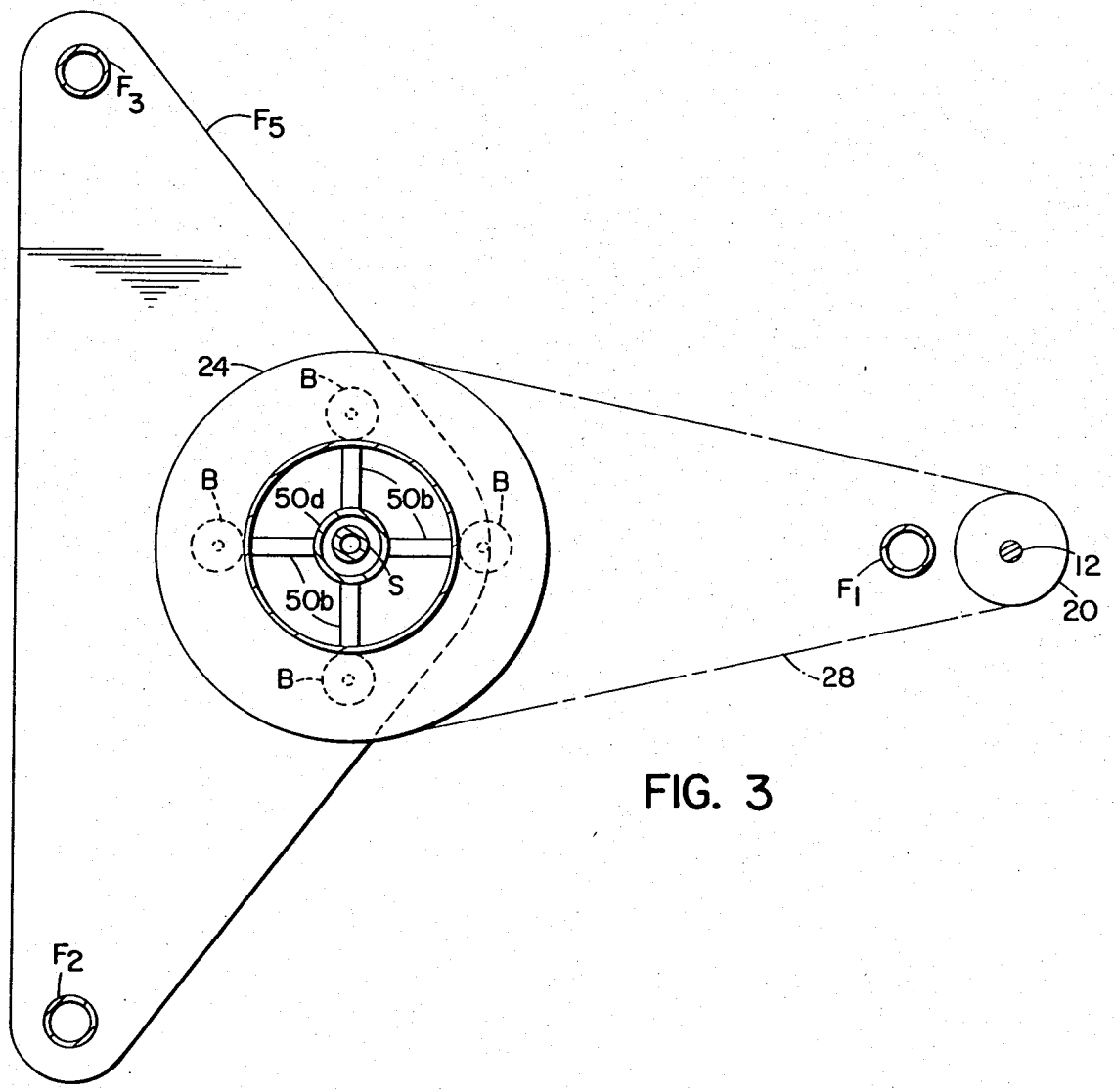
FIG. 3 is a horizontal sectional view taken generally on the line 3—3 of FIG. 1.

Turning now to the drawings in greater detail, and referring particuarly to FIGS. 1, 2 and 3 inclusively, a fixed frame is provided for supporting the rotating tub structure T and also for supporting the feed tube 50 and its associated rake means to be described. The fixed frame includes a circular base F having at least three upstanding frame legs or posts F1, F2 and F3. The base F also includes a center portion F4 which may be secured to the base F by suitable radially extending struts (not shown). A fixed spindle S is provided in centered relationship in the base F4 to define a vertical axis on which the tub and rotating feed tube and rake means rotate.

Figure 4:
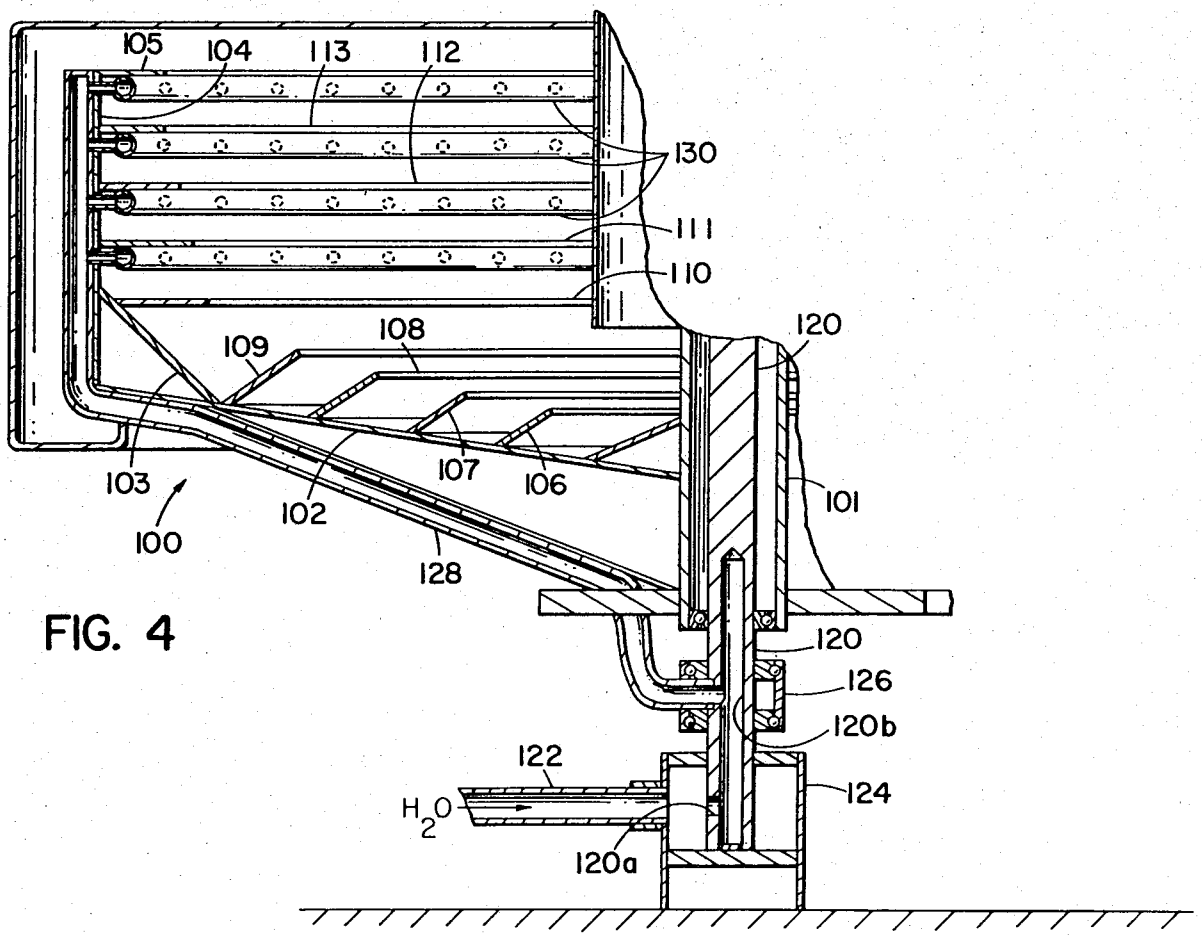
FIG. 4 is a view of an alternative form for the rotating tub illustrated in FIG. 1. The slurry feeding means together with the rotating rake means of FIG. 1 have been omitted from FIG. 4 so as to better illustrate the differences between the FIG. 4 tub structure and the tub structure illustrated in FIG. 1.

Still with reference to the fixed structure of the FIG. 1 device a feed tube support bracket F5 is provided between at least two of the posts F2 and F3 (best shown in FIG. 3) and this bracket F5 defines an annular bearing B for rotatably supporting the feed tube 50. This bearing B comprises a plurality of bearing wheels as best shown in FIG. 3 at circumaxially spaced locations in the bracket F5. An enclosure E is also provided in fixed relationship to the frame, and this enclosure is of generally cylindrical configuration having a top surface defining an opening through which the feed tube 50 extends and the enclosure E also defines a lower trough E1 of annular configuration, and the trough E1 has an exit opening as best shown at E2 in Fig. 1 through which the devalued gravel and water are adapted to be discharged as a result of the action of paddles such as that shown at P in FIG. 1 and provided for this purpose on the periphery of the rotating tub T. Still with reference to the fixed structure illustrated in FIG. 1 an infeed water pipe 56 is provided to supply water to the top portion of the fixed spindle S and more particularly to the chamber of a fluid coupling 58 so that a rotating water manifold pipe 60, 62 can be continuously supplied with water under pressure for a purpose to be described below. The fluid coupling 58 is of conventional configuration having an inner part secured to shaft S and an outer part that rotates relative to the inner part and has a port connected to the rotating water manifold. FIG. 4 shows such a coupling at 126 in somewhat greater detail than shown for the coupling 58 in FIG. 1.

A drive unit 10 is adapted to rotate a vertical drive shaft 12 which drive shaft is rotatably supported in fixed bearings 14 and 16 as shown at the right hand side of FIG. 1. The drive shaft 12 has sprockets 18 and 20 splined thereto for operating drive chains 26 and 28 respectively. Drive chain 26 rotates a sprocket 22 provided on the lower portion of the tub T and more particularly provided on a lower end of the tub center post T1. Chain 28 drives a sprocket 24 associated with the feed tube 50 and it is a feature of the present invention that the feed tube 50 is driven at a slightly slower speed than that of the tub T as a result of the respective pitch diameters of the sprockets 22 and 24 associated with each of these rotating elements.

The ore, gravel slurry is provided to the feed tube through an upper funnel shaped portion 50*a* from a feed spout as illustrated by the broken lines in FIG. 1. The general aim of the present invention is to provide a tub T for receiving this slurry and separating the slurry into its components as a result of the differing density as between the gravel and the gold ore. The tub T has a center post portion T1 adapted to rotatably support the tub T for rotation on the vertical axis defined by the fixed spindle S and the tub T has a bottom wall T2 that is inclined outwardly and upwardly and communicates and is connected to an intermediate wall T3 have a steeper slope. A vertical outer wall T4 of the tub T is connected to wall T3 such that the maximum centrifugal force will be exerted on the contents of the tub in the upper and outer regions thereof adjacent to the vertical wall T4.

Annular dams are provided inside the tub on these walls T2, T3, and T4 and these annular dams or ribs define annular spaces therebetween, into which spaces the heavier components of the slurry are adapted to be thrown during rotation of the tub. As mentioned previously water is provided through the feed tube 50 along with the ore and gravel. Additional water is provided into these annular spaces through tines 70, 70 to be described, from the manifold 60/62 referred to previously. The tines 70, 70 exert a raking action in the gravel causing the gravel to float in the water and the gold particles to move through the "quick sand" condition so achieved. Centrifugal force acts on the particles so that the heavier minerals are thrown through this fluid "quick sand" condition in the gravel. Ore and water are fed to the tub T and pass over each of the annular dams. The water travels on up the outside wall of the tub so that water ultimately passes over the uppermost dam T5 and thence into the trough E1 defined by the enclosure E and outwardly through the exit E2. As mentioned previously peripheral paddles P serve to expedite the flow of the water through this channel or trough E1, and out the exit E2. The heavier metals and concentrates are trapped by the annular dams and the rake tines moving slowly in a direction parallel to these dams contributes to this process of centrifugal separation. Some tines have water nozzles to further improve separation.

As best shown in FIG. 1 the annular dams T6, T7, T8, T9 and TlO are inclined inwardly toward the central axis of the tub and upwardly toward the top of the tub whereas the dams T11, T12, T13 and T5 are defined by horizontally extending annular shelves secured to the vertical side wall T4 of the tub.

Still with reference to the tub T a second lower tub wall T14 is provided below the inclined wall T2 so as to strengthen the tub structure itself. A drain plug T15 is provided in this lower wall structure T2/T14 in order that the tub can be conveniently flushed out after extended periods of use. So too, the vertical wall T4 of the tub extends downwardly to meet with the outer end portion of the lower wall T2 and to define a triangular cross sectional configuration for the tub in the area of the intermediate tube side wall T3. This geometry also serves to enhance the structural integrity of the tub and to provide a convenient surface for mounting the peripherally spaced paddles referred to previously.

Turning now to a more detailed description of the feed tube 50 and its associated rake means. The preferred form for the rake means is a plurality of spokes 52, 52 and a hoop or ring member 54 associated therewith. This entire structure is rotatably supported on the same vertical axis as that for the rotating tub T and the fixed spindle S has its upper end extending beyond the center post portion T1 of the tub so as to rotatably receive a support post **50*d* associated with the feed tube 50. The tube is integrally connected to said post 50*d* by internal spiders 50*b*, 50*c*. This support post portion 50*d* of the feed tube 50 also has bearing means between it and the top portion of fixed spindle S in order to provide for relative rotation between the spindle S and the feed tube 50**.

The feed tube 50 not only serves as a convenient means for receiving the slurry of gold ore, gravel and water as mentioned previously, but also serves as a hub for the rake means to be described. This rake means comprises generally radially extending spokes 52, 52 each of which is secured to the outside wall of the tube 50 as best shown in FIG. 1. Each such spoke 52 is also connected at its outer end to the annular ring or hoop member 54 as best shown in FIG. 2. FIG. 2 shows that the spoke members 52 are configured in a generally arcuate fashion so that they extend radially outwardly and comprise a convenient platform for mounting depending tines 70, 70 thereto such that the lower end portions of these tines project into annular spaces defined between the spaced annular dams referred to previously in the tub. Actually, each such tine 70 comprises a hollow pipe or conduit. The lower end of at least some tines define a nozzle for ejecting water under pressure. The upper end of each tine is secured to the spoke 52 by U-bolts 66 attached to these spokes 52 as best shown in FIG. 2. the upper end of each tine 70 is connected or communicates with a radially extending water feed tube 64 and this feed tube 64 is generally L-shaped having an outer end portion **64*a* arranged alongside an adjacent portion of the hoop shaped ring member 54. Additional depending tines 72, 74, 76 and 78 are provided on this adjacent portion of the ring member 54** and have their lower nozzle end portions so located as to discharge water under pressure into the annular spaces defined between the uppermost and outermost annular dams T11, T12, T13 and T5.

DETAILED DESCRIPTION OF FIRST ALTERNATIVE EMBODIMENT

FIG. 4 illustrates an alternative configuration for a tub 100 wherein the tub has a lower inside wall 102 generally similar to that described previously with reference to T2 and an inclined intermediate wall 103 generally similar to that referred to previously with reference to tub T at T3. Inclined annular dams 106, 107, 108 and 109 are provided and correspond to those described previously with reference to the tub T at T6, T7, T8 and T9. The generally vertically extending cylindrical wall surface 104 is generally similar to the wall surface T4 described previously with reference to the tub T and this wall surface 104 also defines annular dams 105, 113, 112, 111 and 110, these horizontally extending shelf type dams being similar to those described previously with reference to the tub T at T5, T13, T12 and T11. The tub 100 in FIG. 4 also includes a center post portion 101 which portion is adapted to be rotatably received on a fixed spindle 120 which spindle is mounted in the fixed frame 124 in a manner similar to that described previously with reference to spindle S and frame center post portion S4.

A source of water under pressure is provided through fixed inlet pipe 122 and through a port **120*a* in the spindle 120 so as provide a source of water in the internal upwardly extending bore 120*b* of the spindle 120 with the result that a fluid coupling 126 connects said source of water under pressure to line 128, which lines is rotating with the tub 100. This line 128 extends up the outer surface of the tub 100 and serves to provide water under pressure to annular tubes 130 provided just under the horizontally extending shelf shaped dams 105, 113, 112, and 111 referred to previously. These annular pipes 130 have nozzle openings oriented radially outwardly to inject an additional quantity of water into the slurry. This orientation reduces any tendency for the openings to clog with gravel or ore, and facilitates the "quick sand" condition desired to carry off the lighter components of the materials being separated so that in the version of FIG. 4 water is not only provided to inlet pipe 56 as shown in FIG. 1, and to the top of spindle shaft 120 (not shown), and thence through the nozzle openings defined in the lower ends of the tines 70, 70 as described previously, but water is also provided through the nozzle openings defined in these annular pipes 130 in the FIG. 4 version. It will be apparent that the feed tube and its associated rake means as described previously, can be adapted for use in the tub of FIG. 4. Fig. 4 represents a further improvement over the invention disclosed and described hereinabove with reference to FIGS. 1, 2 and 3**.

I claim:

1. A separator for extracting gold from a slurry of ore, gravel and water, and comprising in combination:

(a) a fixed frame including tub support spindle means, (b) an upwardly open tub rotably mounted to said tub support spindle means having a plurality of spaced annular dams projecting from the interior walls of said tub, said annular dams defining annular spaces therebetween, (c) means for receiving a slurry of gold ore gravel and water into said tub, said slurry receiving means being rotatably monted to said spindle means, (d) rake means fixedly mounted to said slurry receiving means, said rake means having radially spaced portions provided between the annular dams, (e) means for rotating said tub and said slurry receiving means in the same direction but at slightly different rotational speeds on a vertical axis defined by said spindle means, and (f) outlet means for the water and gravel spilling from said upwardly open tub.

2. The combination of claim 1 wherein said tub support means comprises a fixed upright spindle defining said vertical axis, the lower end of said spindle being fixed in the frame.

3. The combination of claim 2 wherein said tub includes a center post portion, and wherein bearing means is provided between said tub center post portion and said spindle.

4. The combination of claim 3 wherein said means for receiving said slurry comprises a feed tube arranged generally concentrically with respect to the fixed spindle means, and an internal support structure including bearing means provided between the spindle means and the tube, said tube support structure including an internal spider defining a generally annular passage around the spindle means through which the slurry is adapted to pass downwardly as aforesaid.

5. The combination of claim 2 wherein said means for receiving said slurry comprises a feed tube arranged generally concentrically with respect to the fixed spindle means, and an internal support structure including bearing means provided between the spindle means and the tube, said tube support structure including an internal spider defining a generally annular passage around the spindle means through which the slurry is adapted to pass downwardly as aforesaid.

6. The combination of claim 1 wherein said means for receiving said slurry comprises a feed tube arranged generally concentrically with respect to said spindle means, and an internal support structure including bearing means provided between the spindle means and the tube, said tube support structure including an internal spider defining a generally annular passage around the spindle means through which the slurry is adapted to pass downwardly as aforesaid and rake means comprising a plurality of circumaxially spaced spokes connected at the inner ends to said feed tube.

7. The combination defined by claim 6 wherein said rake means further comprises depending tines on said spokes, said tines having ends defining said portions provided in said annular spaces defined by said annular dams.

8. The combination of claim 7 wherein said rake means further comprises a hoop shaped ring member connected to the outer ends of said spokes, and additional tines mounted to said ring member, said additional tines having free end portions provided in at least the outermost one of said annular spaces so defined by the outermost annular dams.

9. The combination of claim 8 wherein said rake means further comprises water manifold means, at least certain of said tines having water nozzles in the end portions thereof, and means including said spindle means for coupling said water manifold to a source of water under pressure so that water under pressure is adapted to emanate from said nozzles and act on the slurry in the annular spaces in order to agitate the gravel and gold and thereby assist in separating these materials from one another by centrifugal action.

10. The combination of claim 7 where said rake means further comprises water manifold means, at least certain of said tines having water nozzles in the end portions thereof, and means including said spindle means for coupling said water manifold to a source of water under pressure so that water under pressure is adapted to emanate from said nozzles and act on the slurry in the annular spaces in order to agitate the gravel and gold and thereby assist in separating these materials from one another by centrifugal action.

11. The combination of claim 6 wherein said rake means further comprises a hoop shaped ring member connnected to the outer ends of said spokes, and tines mounted to said ring member, said tines having free end portions provided in at least the outermost one of said annular spaces so defined by the outermost annular dams.

12. The combination of claim 11 wherein said rake means further comprises water manifold means, at least certain of said tines having water nozzles in the end portions thereof, and means including said spindle means for coupling said water manifold to a source of water under pressure so that water under pressure is adapted to emanate from said nozzles and act on the slurry in the annular spaces in order to agitate the gravel and gold and thereby assist in separating these materials from one another by centrifugal action.

13. The combination of claim 12 wherein said tub includes a center post portion, and bearing means provided between said center post portion of said tub and said fixed spindle.

14. The combination defined in claim 12 wherein said tines having ends defining said portions provided in said annular spaces defined by said annular dams.

15. The combination of claim 6 wherein said tub includes a center post portion, and wherein bearing means is provided between said center post portion of said tub in said fixed spindle.

16. The combination according to claim 1 wherein said tub includes a water manifold, and fluid coupling means provided on said fixed spindle to supply water under pressure to the water manifold which rotates with said tub, and annular pipes provided in the annular spaces between the annular dams of at least some of said tub defined dams to inject water under pressure into the annular spaces defined between said dams.

17. The combination according to claim 1 further characterized by an enclosure for said tub, said outlet means comprising an outer annular portion of said tub defining a channel or trough to receive water and entrained materials travelling over said dams to exit said tub.

18. The combination of claim 17 wherein said tub has paddles to act on water in said trough.

* * * * *